US006398107B1

(12) United States Patent
Neri

(10) Patent No.: US 6,398,107 B1
(45) Date of Patent: Jun. 4, 2002

(54) METHOD AND A MACHINE FOR PLACING GROUPS OF SHEETS, PARTICULARLY BANKNOTES, IN CASSETTES

(75) Inventor: Armando Neri, Bologna (IT)

(73) Assignees: G.D. S.p.A., Bologna (IT); Currency Systems International, Inc., Irving, TX (US)

( * ) Notice: Subject to any disclaimer, the term of this patent is extended or adjusted under 35 U.S.C. 154(b) by 0 days.

(21) Appl. No.: 09/302,840

(22) Filed: Apr. 30, 1999

(30) Foreign Application Priority Data

May 5, 1998 (IT) ..... BO98A0282

(51) Int. Cl.[7] ..... G06F 17/60
(52) U.S. Cl. ..... 235/379; 235/380
(58) Field of Search ..... 235/379, 380; 209/534

(56) References Cited

U.S. PATENT DOCUMENTS

| | | | | |
|---|---|---|---|---|
| 4,465,192 A | * | 8/1984 | Ohba et al. | 209/534 |
| 4,538,511 A | | 9/1985 | Wise | |
| 4,703,162 A | * | 10/1987 | Holland-Letz et al. | 235/379 |
| 4,760,923 A | * | 8/1988 | Lundblad et al. | 209/534 |
| 4,787,518 A | * | 11/1988 | Yuge et al. | 209/534 |
| 4,980,543 A | * | 12/1990 | Hara et al. | 235/379 |
| 4,988,849 A | * | 1/1991 | Sasaki et al. | 235/379 |
| 5,256,862 A | * | 10/1993 | Watanabe et al. | 235/379 |
| 5,484,050 A | | 1/1996 | Cheatham | |

FOREIGN PATENT DOCUMENTS

| | | |
|---|---|---|
| DE | 26 56 619 | 7/1977 |
| EP | 811 956 A2 | 12/1997 |
| IT | BO96A 000284 | 5/1996 |
| JP | 62-211244 | 9/1987 |

* cited by examiner

*Primary Examiner*—Karl D. Frech
*Assistant Examiner*—Ahshik Kim
(74) *Attorney, Agent, or Firm*—Colin P. Cahoon; Carstens, Yee & Cahoon

(57) ABSTRACT

Cassettes incorporating at least one container are fed in succession by a first conveyor to a loading station of a machine equipped with channels along which loose banknotes are directed and formed into ordered stacks at outlets of the single channels; the stacks are picked up from each outlet singly and in succession by a clamp mounted to a column-like support and transferred cyclically toward the loading station, where empty cassettes are positioned by a mechanism comprising a shelf and a frame with the bottom of the open container parallel to a side face of the stack. On reaching the station, the clamp and column are maneuvered in such a way as to place the stack in the cassette with the edges of the notes resting against the bottom of the container.

24 Claims, 4 Drawing Sheets

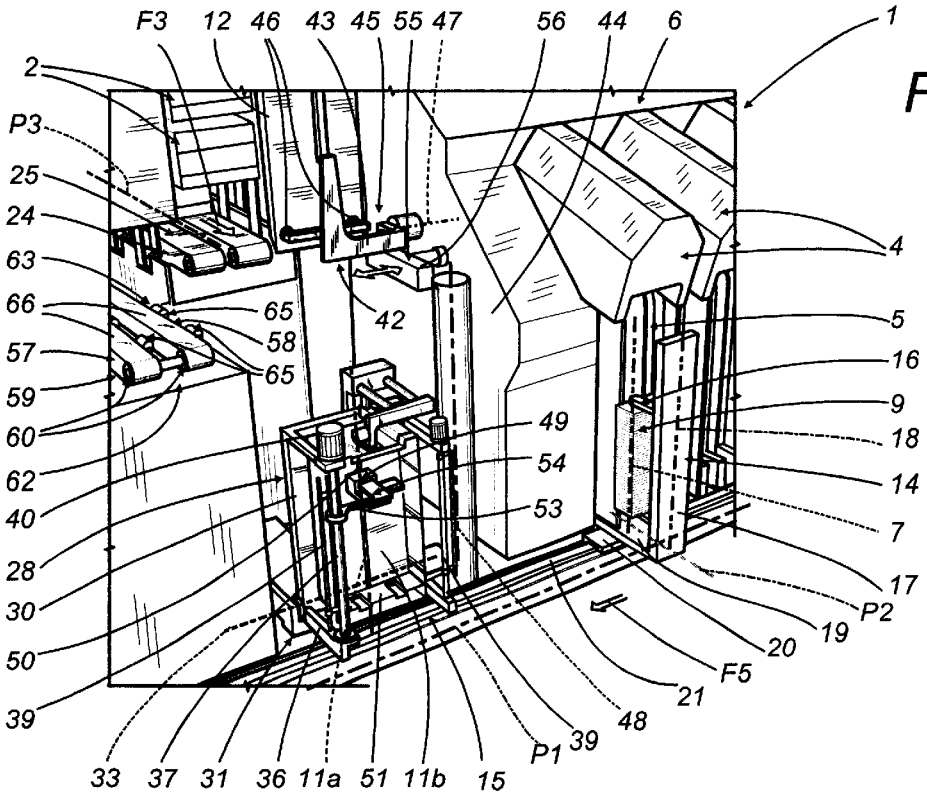
FIG.3
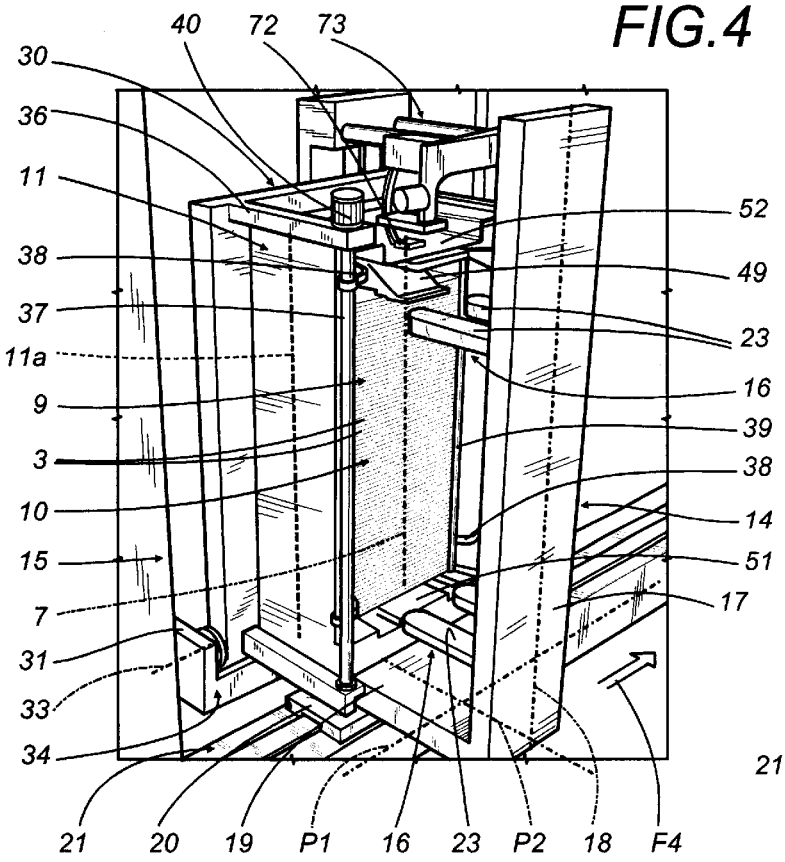
FIG.4
FIG.4a
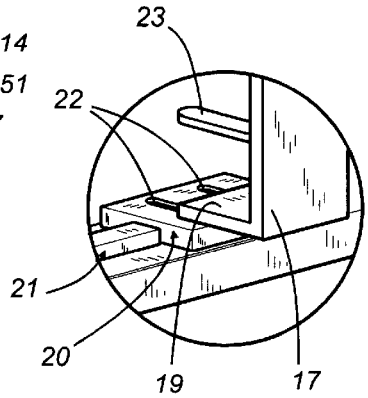

METHOD AND A MACHINE FOR PLACING GROUPS OF SHEETS, PARTICULARLY BANKNOTES, IN CASSETTES

BACKGROUND OF THE INVENTION

The present invention relates to a method of placing groups of sheets, particularly banknotes, in cassettes.

The invention finds application to advantage in machines by which banknotes are first ordered into stacks, singly or in bundles, and then loaded into respective cassettes; reference is made directly to this same art field in the following specification, albeit with no limitation in scope implied.

Machines of the type in question consist typically in a plurality of stacking modules with respective formation channels. The banknotes are fed in singly and in succession, examined and sorted according to denomination and/or type, then directed selectively toward respective independent outlets afforded by the channels.

In this way stacks of single banknotes are formed at each of the outlets. As the notes accumulate in predetermined numbers, the stacks are picked up and transferred to a release station, then taken from the station by hand and put into relative cassettes designed especially for their secure custody, and for their transportation to banks if envisaged.

Conventional cassettes of the type in question comprise a container, and a lid hinged permanently or detachably to the container. The container is also equipped internally with a device by which the stacked notes placed in the cassette are retained in stable fashion.

Given that the operation of placing the stacks in the cassettes is performed manually in machines of the type outlined above, there will inevitably be an area, coinciding substantially with the station at which the stacks are released, where the process of placing and securing the notes in the respective containers is slowed down, and this in turn clearly affects the profitability of the machine overall by slowing down the entire processing cycle.

One object of the present invention is to provide a machine for the formation of notes into ordered stacks, embodied in such a way that the connection with the cassettes and the operation of placing and securing the stacks in the corresponding container can be fully automated in a simple, effective and economical manner.

The prior art embraces machines in which notes can be stacked at the outlets of the formation channels either individually, as already intimated, or in bundles, already checked and strapped or banded.

A further object of the invention is to provide a machine such as will perform the aforementioned operation automatically and with equal ease whether handling stacks of single notes or stacks of notes in bundles.

SUMMARY OF THE INVENTION

The stated objects can be realized, according to the present invention, by adopting a method for placing groups of sheets in cassettes, particularly banknotes emerging from the checking station of a machine comprising a plurality of stacking modules each provided with a respective formation channel along which the notes are directed to form at least one ordered stack of banknotes at an outlet of the channel, substantially parallelepiped in shape with side faces parallel to a stacking axis, wherein the X cassette comprises at least one container.

The method disclosed comprises the steps of taking up successive stacks of banknotes cyclically from each outlet though the agency of pickup and transfer means; transferring each stack to a release and load station; feeding a succession of empty cassettes cyclically and synchronously with the operation of the pickup and transfer means toward an area of substantial proximity to the release and load station; positioning the cassette and the pickup and transfer means one relative to another in such a way as to allow their mutual interaction; placing each successive stack in the relative cassette with the edges of the banknotes resting against the bottom of the container.

Yet another object of the present invention is to provide a machine for placing groups of banknotes into cassettes, capable of implementing the method disclosed.

The object in question is realized in a machine by which groups of sheets, particularly banknotes, are placed in cassettes, comprising a plurality of stacking modules each provided with a respective formation channel along which banknotes emerging from a checking station are directed in such a manner as to accumulate at an outlet of the channel into at least one ordered stack, substantially parallelepiped in shape and disposed with side faces parallel to a stacking axis, wherein the cassette comprises at least one container.

Such a machine comprises cassette feed means by which empty cassettes are directed in succession into an area of substantial proximity to a release and load station; pickup and transfer means capable of movement sequentially, and synchronously with the cassette feed means, between at least two operating positions including a first position in which the pickup and transfer means take up a stack of banknotes from the single outlet, and a second position in which the stack is directed by the pickup and transfer means toward the release and load station; and positioning means located in substantial proximity to the release and load station, of which the function is to position the cassette relative to the pickup and transfer means in such a manner as will enable the pickup and transfer means, when in the second operating position, to place the relative stack in the empty cassette with the edges of the banknotes resting against the bottom of the container.

BRIEF DESCRIPTION OF THE DRAWINGS

The invention will now be described in detail, by way of example, with the aid of the accompanying drawings, in which:

FIGS. 2 to 6 illustrate details of FIG. 1 in a succession of operating steps whereby a stack of banknotes is placed in a respective cassette;

FIG. 4*a* shows a detail of FIG. 4;

DESCRIPTION OF THE PREFERRED EMBODIMENTS

Figure 1:
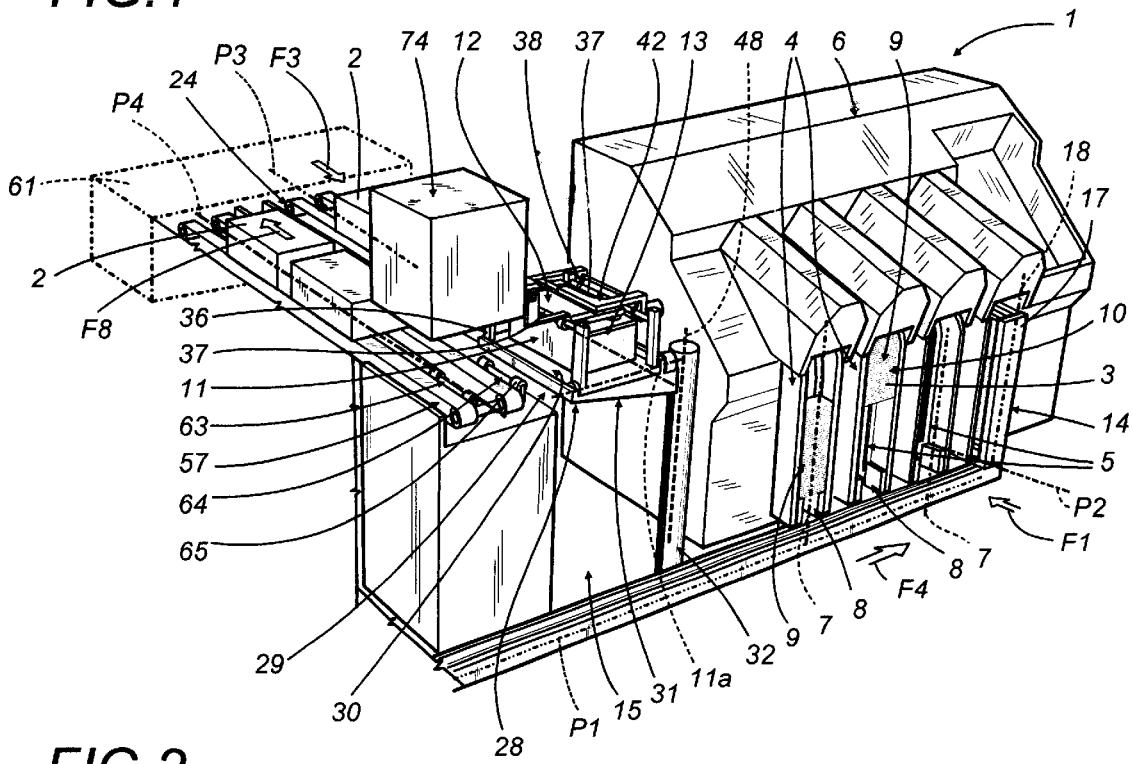
FIG. 1 illustrates the machine according to the present invention in a first preferred embodiment, viewed schematically and in perspective, and with certain parts omitted for clarity.

Referring to FIG. 1 of the drawings, 1 denotes a machine, in its entirety, for placing groups of sheets into respective cassettes 2, the sheets being banknotes 3 in this particular instance.

The machine 1 comprises a plurality of stacking modules 4 with respective formation channels 5, substantially of the type as described in Italian patent application no. BO96A 000284 of which the content is imported into the present specification; banknotes 3 emerging from a checking station 6 are directed down each channel 5 and along a respective stacking axis 7 toward a relative outlet denoted 8, and formed into an ordered stack 9 of substantially parallelepiped form disposed with the side faces 10 parallel to the stacking axis 7. The cassettes 2 are of a conventional type designed specifically to contain the stacks 9 of banknotes 3, consisting in a container 11 with a predominating longitudinal axis 11*a*, and a bottom denoted 11*b*, enclosed by a lid 12 which is hinged to the container 11 along one of the two top transverse edges 13 (see FIG. 5), either permanently or detachably.

In the example of FIG. 1, the machine 1 comprises pickup and transfer means 14 disposed and embodied in such a way as to take up a stack 9 of notes 3 from each outlet 8 of each stacking channel 5 and transfer it toward a release and load station 15 where the stack 9 is placed by the selfsame pickup and transfer means 14 in the container 11 of the cassette 2 with the notes 3 disposed on edge and with one side face 10*a* of the stack offered to the bottom 11*b* of the container 11.

Figure 2:
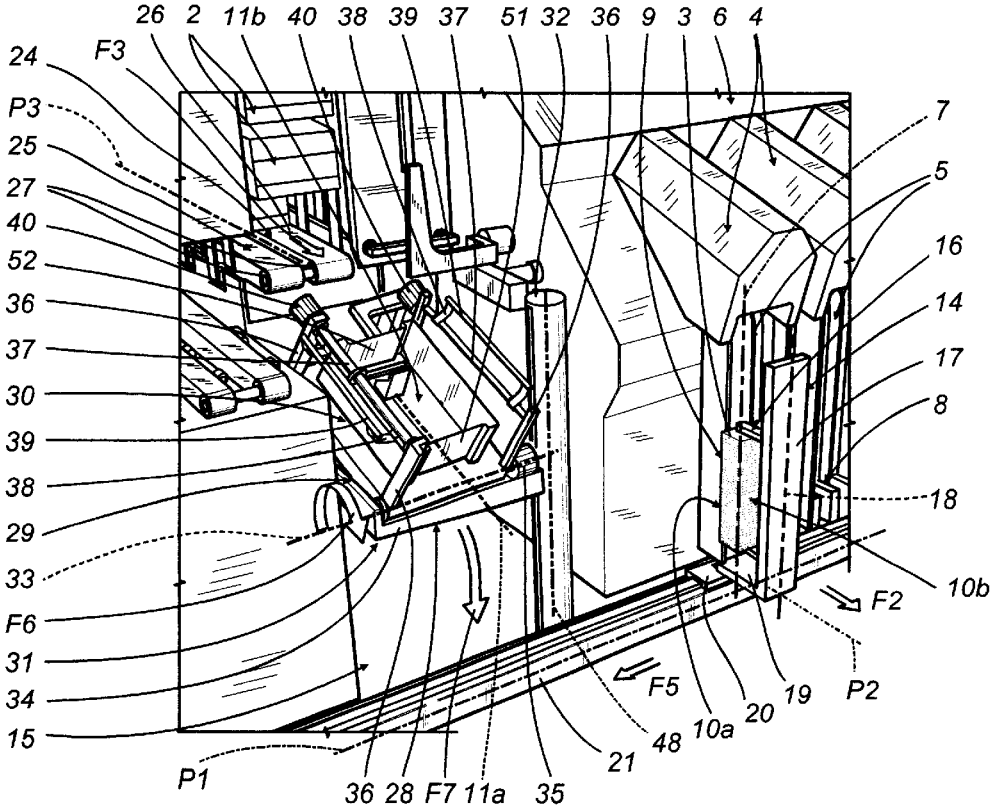

Observing FIGS. 2, 3 and 4, it will be seen that pickup and transfer means 14 comprise a clamp 16 carried on a column type support 17 extending along an axis 18 substantially parallel to the stacking axis 7. The column support 17 is mounted at the base 19 to a carriage 20 slidable on respective ways 21 that extend along a first predetermined transfer path P1 passing substantially across the front of the stacking modules 4 and of the release and load station 15 in a direction substantially transverse to the stacking axis 7.

In addition, the base 19 of the column support 17 is coupled to the carriage 20 by way of interposed cross slide means 22, conventional in embodiment and indicated only in part (FIG. 4), thus rendering the support 17 capable of movement back and forward relative to the carriage in directions denoted F1 and F2 respectively, along a second predetermined transfer path P2 substantially perpendicular to the first path P1.

The clamp 16 is equipped with two jaws 23 of "U" shape, top and bottom respectively, positioned in such a way that the stack 9 of banknotes 3 can be taken up and compacted between them, of which the opening and closing movement is brought about substantially along the axis 18 of the support 17 through the agency of conventional drive means not illustrated in the drawings.

As illustrated in FIGS. 1, 2 and 3, the machine 1 also comprises feed means 24 for the cassettes 2, consisting in a substantially horizontal first infeed conveyor 25 composed of a pair of belts 26 looped around respective pulleys 27 and designed to direct a succession of empty cassettes 2 along a first predetermined feed path P3 in a corresponding direction denoted F3 toward means 28 by which the cassettes 2 are positioned.

The positioning means 28 consist in respective holding and handling means 29 comprising a shelf 30 onto which each cassette 2 is directed and brought to a halt, a frame 31 supporting the shelf 30, and a hydraulic or mechanical jack 32. The frame 31 is cantilevered from the jack 32 and able thus to move up and down on the jack when in operation, carrying the shelf 30 between a raised first position of substantial alignment with the runout of the first conveyor 25, in which the empty cassettes 2 are received, and a second lowered position in which the shelf occupies the release and load station 15. The shelf 30 is hinged along a relative axis 33 to a portion 34 of the frame 31 positioned near to the jack 32, rotatable thus about the axis 33 relative to the frame 31 through the agency of a motor 35 aligned on the axis 33.

As illustrated in FIGS. 2, 3, 4 and 5, the shelf 30 is provided substantially at the corners with four upright elements 36 serving to restrain and support the cassette 2, of which the top ends, disposed in pairs either side of the predominating longitudinal axis 11*a* of the container 11, also serve to support two respective shafts 37 disposed substantially parallel with the selfsame longitudinal axis 11*a*.

Each shaft 37 carries two rigidly associated curved brackets 38 which in turn carry respective check rails 39 capable of movement during operation of the machine, through the agency of drive means 40 operating on each shaft 37, between an at-rest position outside the dimensional compass of the container 11, in which no contact is made with the stack 9 of notes 3 placed in the container 11 by the pickup and transfer means 14, and an operating position in which the check rails 39 are rotated into the container 11 and onto a side face 10*a* of the stack 9 opposite from the face 10*a* in contact with the bottom 11*b* of the container 11.

In the example of FIGS. 1, 2, 3 and 4, where the cassette comprises a lid 12 hinged detachably to the container 11, the machine 1 is equipped with means 42, positioned at the runout of the first conveyor 25, by which to open the lid 12 of the cassette.

Such means 42 comprise an arm 43 supported at one end by an upright bulkhead 44 of the machine 1, of which the remaining end is equipped with gripping means 45 of the type utilizing suction cups 46. The arm 43 is rotatable thus about an axis 47 disposed substantially transverse to the aforementioned feed path P3, through the agency of conventional means not indicated in the drawings, between a position of engagement in which the gripping means 45 are aligned with and caused to lay hold on the lid 12, and an open position in which the lid 12 is rotated 90° or thereabouts and set substantially vertical, allowing it to be separated from the container 11 at the moment, during operation, when the container is directed down by the frame 31 toward the release and load station 15.

Still with reference to FIGS. 1, 2, 3 and 4, the cassette 2 is equipped internally with a respective clip 49 serving to compact the stack 9 of notes 3 internally of the container 11. The clip 49 is capable of movement along a track 50 associated with the bottom 11*b* of the container 11, opposing the action of spring means (not illustrated, being conventional in embodiment) by which it will be forced normally toward an at-rest position, parked substantially against one of the two transverse walls 51 and 52 of the container. The clip 49 is capable of movement between the at-rest position, and an operating position assumed when a stack 9 of notes 3 is taken up and offered to the bottom 11*b* of the container 11 and thereupon compacted by the selfsame clip 49 against the opposite transverse wall 51 of the container through the action of the spring means.

To this end, one of the two shafts 37 will carry an arm 53 by which the clip 49 can be primed. The projecting end of the arm 53 exhibits a retaining element 54 by which the clip 49 is engaged, whilst the remaining end is keyed to the shaft 37, along which it is caused to slide through the agency of the drive means 40 operating in conjunction with relative transmission means of conventional type (not indicated) located internally of the shaft 37; the arm 53 is also caused by these same means to rotate between an at-rest position outside the dimensional compass of the container 11, and an operating position in which the clip 49 is engaged by the retaining element 54. Having engaged the clip 49, the arm 53 slides along the shaft 37, dragging the clip 49 into the operating position ready to compact the stack 9 of notes.

In operation, referring to the embodiment of the machine described thus far and to FIGS. 1, 2, 3 and 4, the carriage 20 is set in motion along the first transfer path P1, sliding along the ways 21 in the direction denoted F4 in FIG. 1, in such a way that the column support 17 and the clamp 16 advance cyclically to a first operating position in which the clamp 16 draws into alignment with a stacking module 4 and stops in front of the outlet 8 of the corresponding channel 5. Having reached this first position, the support 17 advances along the second transfer path P2, sliding on the carriage 20 in the direction denoted F1 in FIG. 1 by way of the base 19 and the slide means 22, from a retracted transfer position occupied when advancing along the first transfer path P1, toward a first forward position in which it engages the outlet 8 of the channel 5, whereupon the jaws 23 will take up the stack 9 of banknotes 3 formed previously in the channel along the stacking axis 7. With the stack 9 held secure, the support 17 returns to the retracted position, moving in the direction denoted F2 in FIG. 2, and begins to advance along the first transfer path P1 in the direction denoted F5 in FIG. 2, toward the release and load station 15.

Meanwhile in another operating cycle synchronized with that of the column support 17 described above, a series of empty cassettes 2 will be proceeding singly and in succession on the first conveyor 25, advancing along the first feed path P3 and in the direction denoted F3 toward the shelf 30, which currently occupies the raised first position of substantial alignment with the runout of the first conveyor 25, ready to receive.

Once the cassette 2 has been positioned on the shelf 30, the arm 43 carrying the gripping means 45 will rotate about the relative axis 47 and bring the suction cups 46 into contact with the lid 12 in the position illustrated in FIG. 1. The suction cups grip the lid 12 and the direction of rotation of the arm 43 is reversed, with the result that the lid 12 flips through 90° approximately on its hinge edge 13 into a substantially vertical position, as illustrated in FIGS. 2 and 3, in such a way that it can be detached from the container 11.

The jack 32 begins to lower the frame 31 in the direction denoted F7 in FIG. 2, and at the same time the motor 35 causes the shelf 30 to rotate about its hinge axis 33 relative to the frame 31 in the direction denoted F6. It will be discernible from FIGS. 1, 2 and 3 and from the foregoing description that in transferring from the raised first position of alignment with the first conveyor 25 (see FIG. 1) to the second position occupying the release and load station 15, the empty container 11 describes two distinct movements of which one is a straight descent parallel with the axis 48 of the jack 32, and the other a rotation about the hinge axis 33. As a result of these same two combined movements, the container 11 is brought into the station 15 with its longitudinal axis 11*a* vertically disposed and parallel to the stacking axis 7, and with the bottom 11*b* substantially parallel to the face 10*a* of the stack 9 of notes 3 gripped between the jaws of the clamp 16 carried by the column support 17, which in the meantime will have moved into the station 15 and now stands directly in front of the open container 11.

At this point the column support 17 moves forward along the second transfer path P2 in the direction denoted F1 in FIG. 1 and, in exactly the same manner as when picking up the stack, described previously, advances from the retracted position to a second forward position in which the stack 9 is inserted into the container 11 with the forward most side face 10*a* resting against the bottom 11*b*.

At the moment the stack 9 locates against the bottom 11*b* of the container 11, the check rails 39 are rotated from their at-rest position toward the inside of the container and brought to rest on the side face 10*a* of the stack 9, restraining the notes against the bottom 11*b* of the container so that the clamp 16 can release the stack 9 and the support 17 is free to draw back to its intermediate transfer position.

During the step of releasing the stack 9 inside of the container 11, the priming arm 53 is caused by the drive means 40 to move into the operating position and the associated retaining element 54 to engage the clip 49. The arm 53 thereupon draws back along the shaft 37 with the result that the clip 49 is also dragged along and caused in turn to assume its operating position ready to compact the stack 9 released by the clamp 16.

Figure 5:
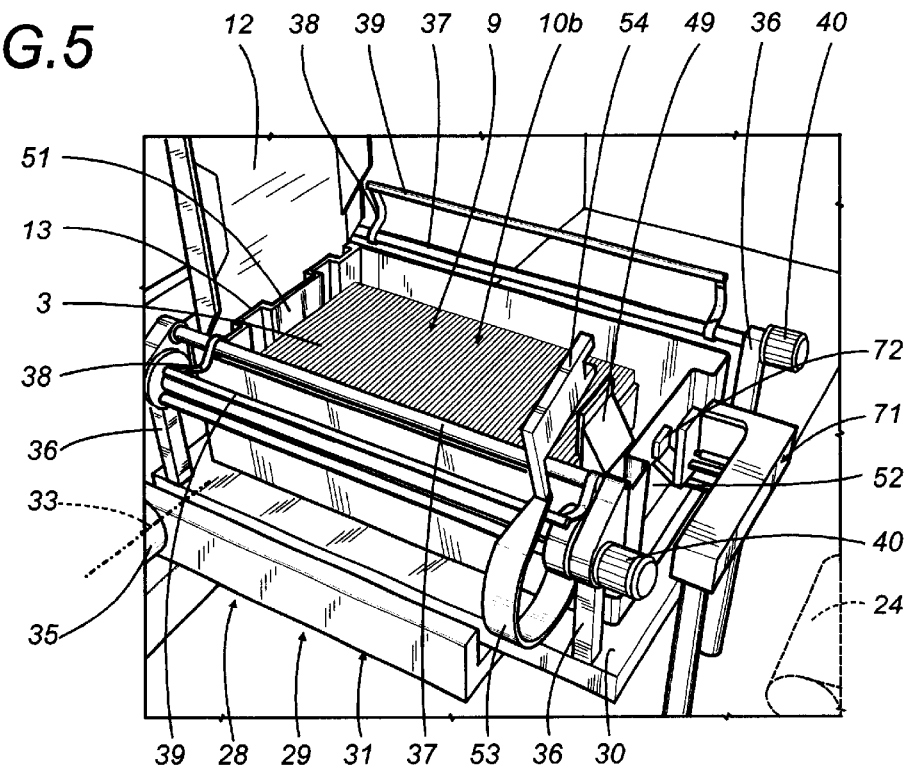

On completion of the step whereby the stack 9 is released and loaded into the container 11, the frame 31 is returned by the jack 32 to the raised position, the shelf 30 rotates about the relative hinge axis 33 in the direction opposite to that denoted F6, regaining the substantially horizontal position in the same plane as that occupied by the frame 31, and the container 11 is restored to the raised first position of alignment with the first conveyor 25, allowing the lid 12 to be reattached to the hinge edge 13 as indicated in FIG. 5.

Once the lid is closed through the action of the gripping means 45 and the arm 43, rotating about the axis denoted 47, the cassette 2 will again be in the position occupied initially and indicated in FIG. 1.

Figure 7:
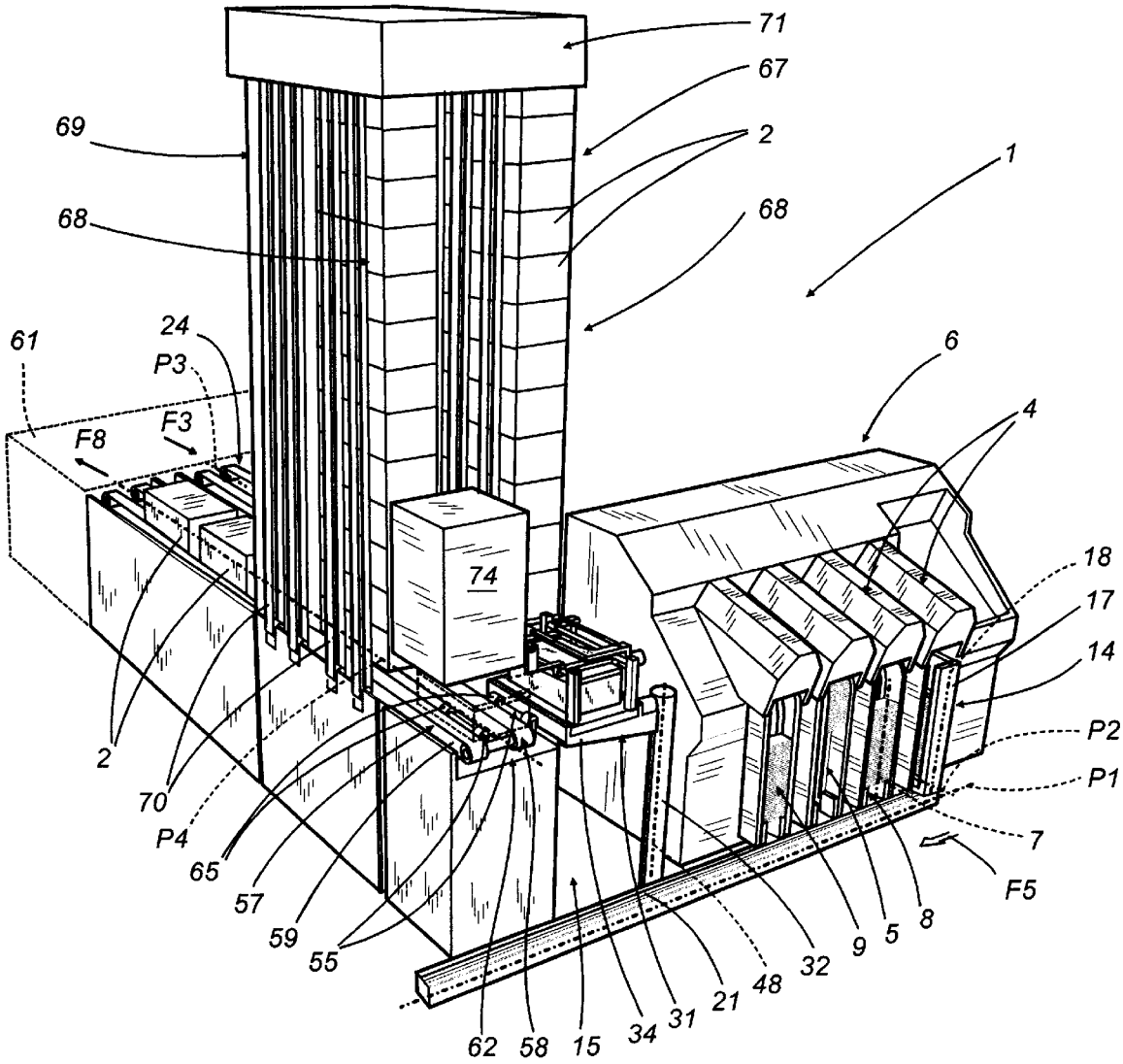
FIG. 7 illustrates the machine according to the present invention in a second preferred embodiment, viewed schematically and in perspective and with certain parts omitted for clarity.

Observing FIGS. 2, 3 and 7 and the raised position of substantial alignment with the first conveyor 25 occupied by the shelf 30 onto which the cassettes 2 are directed, the machine 1 will be seen also to comprise means 55 by which filled cassettes 2 are removed and distanced from the selfsame shelf 30; in the example of FIG. 3, these consist in a push rod 56 supported by the upright bulkhead 44 of the machine 1 in a position beneath the arm 43, and a second out feed conveyor 57, comprising first and second belts 58 and 59 extending one alongside the other, along which the filled cassettes are carried away. The two belts 58 and 59 are looped around respective pulleys 60 and extend parallel to the belts 26 of the first conveyor 25 along a feed path denoted P4. The function of the second conveyor 57 is to direct the filled cassettes 2 away along a predetermined direction F8 toward a receiving and processing station indicated schematically by the block denoted 61 in FIG. 1. An entry portion 62 of the second conveyor 57 is equipped with respective slide means 63 supporting the containers 11 of the cassettes and operating in conjunction with the push rod 56 to transfer the cassettes 2 from the shelf 30 to the conveyor 57, which is positioned at a level slightly lower than the shelf. The slide means 63 consist in a pair of shafts 64 extending parallel to the belts 58 and 59 and located one on either side of the first belt 58, in such a manner that one of the shafts 64 is positioned between the belts 58 and 59. The shafts 64 are equipped with respective wheels 65 at either end and carried by a frame of conventional embodiment (not indicated), by which the wheels 65 can be moved between a raised position, lying at a height above the top branch 66 of the belts 58 and 59, and a lowered position lying at a height below that of the same top branch 66.

In operation, on completion of the cycle whereby a stack 9 of banknotes 3 is taken up and placed in a respective container 11, and with the cassette 2 occupying the position illustrated in FIG. 1, the shafts 64 are elevated to the raised position, in which the wheels 65 lie above the top branch 66 of the belts 58 and 59 substantially on a level with the shelf 30. The push rod 56 now moves away from the bulkhead 44 of the machine 1 and directs the cassette 2 transversely to the two feed paths P3 and P4 onto the wheels 65, as indicated in FIG. 7. The moment that the cassette 2 is in a position straddling both the belts 58 and 59 of the second conveyor 57, the shafts 64 drop to the lowered position, whereupon the cassette 2 is released by the wheels 65 onto the conveyor 57 and transferred toward the receiving and processing station 61.

All of the cycles described thus far are repeated in succession for each empty cassette 2 destined to be filled with a respective stack 9 of banknotes 3.

In the example of FIG. 7 the machine 1 is equipped with a cassette storage device or magazine 67 set above the first and second conveyors 25 and 57, infeed and out feed respectively, in a substantially median position relative to the two feed paths P3 and P4. The magazine 67 incorporates two storage columns 68 and 69 for each of the conveyors 25 and 57, positioned in series along the feed paths P3 and P4. As discernible from FIG. 7, each column 68 and 69 is equipped on the two side walls parallel to the first and second conveyors 25 and 57 with respective belts 70 between which the cassettes 2 are gripped and moved along the columns 68 and 69.

The columns 68 and 69 are surmounted by means 71 of which the function is to transfer the single cassettes 2 from one column to the other in the direction of the respective feed paths P3 and P4. Such transfer means 71 are of conventional type, and indicated schematically in FIG. 7 by a single block.

Figure 6:
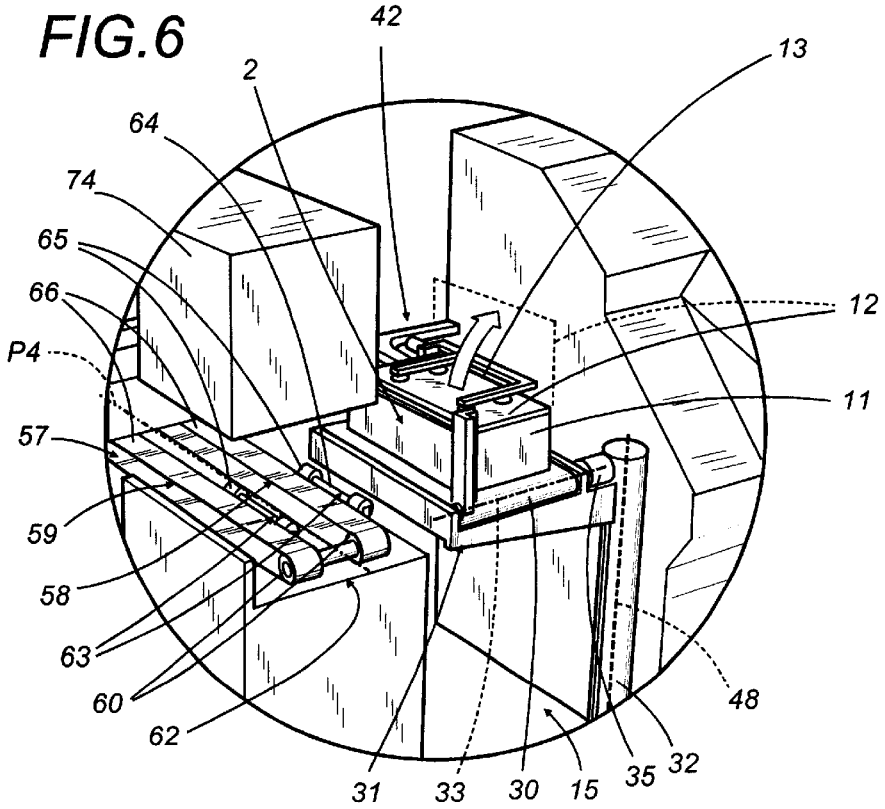

Each individual cassette 2 may be fitted with a lock 72 by means of which the lid 12 is secured to the container 11, and in this instance the shelf 30 will also be equipped with means 73 of conventional embodiment for unfastening the lock 72, of which the operation is timed with that of the means 42 for opening the lid 12. In the example of FIG. 6 the lid 12 is hinged to the container 11 along one of the longitudinal edges 13, again either permanently or detachably.

The operation of opening a longitudinally hinged lid 12, performed by the relative means 42, is no different to the same operation when implemented on a lid 12 hinged transversely to the container 11, except that the opener means 42 rotate about an axis parallel to the hinge edge 13.

Finally, the machine would be equipped with an electronic device able to write and/or read a code identifying the contents of the cassette 2, i.e. the number of banknotes 3 and possibly the type or denomination. The device in question, indicated schematically in FIGS. 1, 6 and 7 by a block 74, is located between the runout of the first conveyor 5 and the entry portion 62 of the second conveyor 57.

What is claimed is:

1. A method of placing groups of sheets in cassettes, typically banknotes emerging from the checking station of a machine comprising a plurality of stacking modules each with a respective formation channel along which the notes are directed to form at least one ordered stack at an outlet of the channel, substantially parallelepiped in shape and presenting its side faces parallel to a stacking axis, wherein the cassette affords at least one container, comprising the steps of:

taking up successive stacks of notes cyclically from each outlet though the agency of pickup and transfer means; transferring each stack to a release and load station; feeding a succession of empty cassettes cyclically and synchronously with the operation of the pickup and transfer means toward an area of substantial proximity to the release and load station; positioning the cassette and the pickup and transfer means one relative to another in such a way as to allow their mutual interaction; placing each successive stack in the relative cassette with the edges of the banknotes resting against the bottom of the container.

2. A method as in claim 1, wherein the step of positioning the cassette and the pickup and transfer means one relative to another includes the step of moving the cassette between a first position of proximity to the release and load station, to which successive cassettes are brought during the feed step, and a second loading position in which the cassette is disposed with the open container facing the pickup and transfer means and the bottom of the container substantially parallel to a side face of the stack of notes held by the pickup and transfer means.

3. A method as in claim 1 for placing sheets in cassettes comprising a container and a lid, wherein the step of positioning the cassette and the pickup and transfer means one relative to another includes a step of opening the lid that consists in gripping the lid through the agency of opener means and rotating it about a free hinge edge of the container to the point of assuming an open configuration such as will allow a stack of notes to be placed inside the container, and moving the cassette toward the second loading position.

4. A method as in claim 3 where dependent on claim 2, wherein the steps of opening a lid hinged detachably to the container and positioning the cassette and the pickup and transfer means one relative to another include the steps of gripping the lid through the agency of opener means and rotating it about a free hinge edge of the container to a position such as will allow the separation of the lid from the container, moving the cassette from the first position of proximity to the release and load station, occupied during the feed step, to the second loading position, and retaining the lid in the position reached at the moment of separation from the container in such a manner that it can be reconnected to the container when the container is returned to the first position after the stack of notes has been loaded.

5. A method as in claim 1, wherein on completion of the step whereby the cassette or the container is moved to the second loading position, the container is disposed with its longitudinal axis and with the bottom substantially vertical and substantially parallel to the stacking axis on which the notes are aligned.

6. A method as in claim 1, wherein the pickup and transfer steps are brought about by positioning the pickup and transfer means in alignment with each of the outlets of the channels each time a stack of banknotes is formed at an outlet, whereupon the stack is picked up and advanced toward the release and load station along a first predetermined transfer path extending substantially across the front of the stacking modules and the release and load station and substantially transverse to the stacking axis.

7. A method as in claim 1, wherein the steps of filling the cassette and returning it to the first position of substantial proximity to the release and load station are followed by steps of closing the filled cassette and distancing it in the direction of a receiving and processing station.

8. A method as in claim 7, comprising a step of storing empty and filled cassettes that involves using and operating a magazine device.

9. A method as in claim 3 for placing sheets in cassettes each equipped with a lock by which the lid is secured to the container, wherein the step of opening the lid comprises a step of opening the lock.

10. A method as in claim 1, wherein the container is equipped internally with clip means of which the function is to admit and compact the stack of notes, comprising the step of positioning the clip means in such a manner that a stack of notes can be taken up from the pickup and transfer means and retained stably inside the container.

11. A method as in claim 1, wherein the step of placing the stack of notes in each cassette comprises the subsidiary steps of inserting the pickup and transfer means into the container by causing them to advance along a second predetermined transfer path, causing one side face of the stack to be engaged by check means of which the function is to pin the stack against the bottom of the container temporarily, withdrawing the pickup and transfer means thereupon from the container by causing them to retract along the second transfer path, and distancing the check means.

12. A machine for placing groups of sheets, typically banknotes, in cassettes, comprising a plurality of stacking modules each provided with a respective formation channel along which banknotes emerging from a checking station are directed in such a manner as to accumulate at an outlet of the channel into at least one ordered stack, substantially parallelepiped in shape and disposed with side faces parallel to a stacking axis, wherein the cassette affords at least one container, further comprising cassette feed means by which empty cassettes are directed in succession into an area of substantial proximity to a release and load station; pickup and transfer means capable of movement sequentially and synchronously with the cassette feed means between at least two operating positions including a first position in which the pickup and transfer means take up a stack of banknotes from the single outlet, and a second position in which the stack is directed by the pickup and transfer means toward the release and load station; also positioning means located in substantial proximity to the release and load station, of which the function is to position the cassette relative to the pickup and transfer means in such a manner as will enable the pickup and transfer means, when in the second operating position, to place the relative stack in the empty cassette with the edges of the notes resting against the bottom of the container.

13. A machine as in claim 12, wherein positioning means comprise means by which to hold and handle the cassette, capable of movement between a first receiving position in which the cassette is taken up from the relative feed means, and a second loading position in which the empty cassette occupies the release and load station, positioned with the open container facing the pickup and transfer means and the bottom of the container substantially parallel to a side face of the stack of banknotes held by the pickup and transfer means.

14. A machine as in claim 12, wherein the pickup and transfer means consist in clamp means capable of movement toward and away from one another along a given axis, carried by a support element of which the predominating axis extends substantially parallel to the stacking axis and coincides with the axis along which the movement of the clamp means occurs, also slide means translatable on respective ways extending along a first predetermined transfer path passing substantially across the front of the stacking modules and the release station and in a direction substantially transverse to the stacking axis, of which the function is to carry the support element and with which the support element is associated in such a manner as will enable its movement cyclically in relation to the selfsame slide means along a second predetermined transfer path substantially perpendicular to the first transfer path between a first forward position in which a stack of notes formed at the outlet of a channel is taken up and held by the clamp means, an intermediate retracted position in which the stack is translated along the first transfer path from each of the outlets of the channels toward the release and load station, and a second forward position in which the stack is placed in the container of a corresponding cassette.

15. A machine as in claim 13, wherein the holding and handling means comprise a shelf on which the single cassettes are received and retained, associated pivotably along a hinge axis with a supporting frame capable of movement between a raised first position in which the shelf occupies the first receiving position in substantial alignment with a runout portion of the cassette feed means, and a lowered position in which the shelf occupies the release and load station, having rotated through a given angular distance about the hinge axis, and the cassette is positioned with the open container facing the pickup and transfer means and the bottom of the container substantially parallel to a side face of the stack of banknotes held by the pickup and transfer means.

16. A machine as in claim 15, wherein rotation through a given angular distance about the hinge axis brings the shelf into the release and load station carrying the cassette with the bottom of the container positioned in such a way that a longitudinal axis of the container is disposed substantially vertical and substantially parallel to the stacking axis on which the notes are aligned.

17. A machine as in claim 12 suitable for cassettes composed of a container and a lid, comprising opener means by which the lid is gripped and rotated about a free hinge edge of the container to the point of assuming an open configuration such as will allow a stack of banknotes to be placed inside the container.

18. A machine as in claim 17 suitable for cassettes comprising a container, and a lid hinged detachably to the container, wherein the opener means are designed to grip the lid and rotate it about a free hinge edge of the container to a position such as will allow the separation of the lid from the container at the moment when the container is transferred by the holding and handling means from the first receiving position to the second loading position, and to retain the lid in the position reached at the moment of separation from the container in such a way that it can be reconnected to the container when the container is returned to the first receiving position.

19. A machine as in claim 17, wherein the opener means comprise an arm equipped with means by which to grip the lid, positioned to coincide with the first receiving position occupied by the holding and handling means and capable of movement about an axis of rotation between a position in which the lid is engaged by the gripping means and a position in which the lid is open.

20. A machine as in claim 15, wherein the shelf on which the cassette is received and held comprises check means disposed and embodied in such a way as to alternate between a position in which no contact is made with the stack of notes when placed in the container by a support element of the pickup and transfer means, and a position of engagement with a side face of the stack opposite to the side face resting against the bottom of the container, in which the stack remains pinned against the bottom of the container as the support element of the pickup and transfer means is retracted subsequently along the second transfer path from the second forward position to the intermediate retracted position assumed when the stacks are transferred along the first transfer path.

21. A machine as in claim 15 suitable for cassettes of which the container is equipped internally with clip means designed to admit and compact the stack of banknotes, comprising means by which to prime the clip means.

22. A machine as in claim 12, comprising means by which the filled cassette is removed and distanced from the first position of substantial proximity to the release and load station, directed away toward a station at which the filled cassettes are received and processed.

23. A machine as in claim 12, comprising a magazine device serving to accommodate empty and filled cassettes, interposed between the cassette feed means and a station at which the filled cassettes are received and processed.

24. A machine as in claim 17 for placing sheets in cassettes each equipped with a lock by which the lid is secured to the container, comprising means by which to open the lock.

* * * * *